United States Patent [19]

Silverman

[11] Patent Number: 4,936,176

[45] Date of Patent: Jun. 26, 1990

[54] MAT CUTTER ALIGNMENT AND SQUARING TOOL

[76] Inventor: David W. Silverman, 180 Sheridan Blvd., Denver, Colo. 80226

[21] Appl. No.: 305,115

[22] Filed: Feb. 2, 1989

Related U.S. Application Data

[63] Continuation-in-part of Ser. No. 61,451, Jun. 15, 1987, abandoned.

[51] Int. Cl.[5] ..... B26D 7/02

[52] U.S. Cl. ..... 83/468; 83/455; 83/614; 83/701; 33/427; 33/464

[58] Field of Search ..... 33/32.1, 32.2, 32.3, 33/427, 464, 670; 83/467 R, 468, 614, 701

[56] References Cited

U.S. PATENT DOCUMENTS 3,626,595 12/1971 Hulen ..... 33/32.2
4,036,486 7/1977 Molpus ..... 83/468
4,228,592 10/1980 Badger ..... 33/427

*Primary Examiner*—Hien H. Phan
*Attorney, Agent, or Firm*—Dorr, Carson, Sloan & Peterson

[57] ABSTRACT

A tool is used simultaneously align and square a conventional mat cutter. The tool is an elongated member (such as a rectangular block) with a bottom surface and at least two perpendicular lateral edges, together with a channel extending across its bottom surface parallel to one of the lateral edges of the tool. The vertical cross-section of the channel is contoured to seat firmly against the guide rail assembly of the mat cutter. Using the guide rail assembly as a fixed point of reference, the perpendicular arms of the mat cutter can be aligned and squared against the lateral edges of the tool. In addition, the tool can be used to ensure correct placement of measuring rulers on the perpendicular arms of the mat cutter.

6 Claims, 3 Drawing Sheets

MAT CUTTER ALIGNMENT AND SQUARING TOOL

BACKGROUND OF THE INVENTION

Related Application.

This application is a continuation of U.S. Patent application Ser. No. 07/061,451, now abandoned and filed 6/15/87.

FIELD OF THE INVENTION

The present invention relates generally to the field of mat cutters used in the preparation of mats for framing. More specifically, the present invention is a tool used to align and square a conventional mat cutter to ensure dimensional accuracy of the finished mat.

PRIOR ART

A number of mat cutters are presently available on the market. The accompanying drawings are based on the "C & H" mat cutter produced by Nielsen Bainbridge of Paramus, N.J. Examples of other types of mat cutters are shown in U.S. Pat. Nos. 3,973,459; 3,463,041; and 3,996,827. In general, mat cutters share the following common elements: (1) two perpendicular side walls or arms against which the mat is abutted; (2) a guide rail or rod extending over the mat parallel to one of the arms; and (2) a cutting assembly that is moved along the guide rail to cut the mat. The accuracy of the resulting cut in the mat is critically dependent upon maintaining proper alignment between the guide rail and the perpendicular arms. Mat cutters in commercial use are often sufficiently out of alignment that errors as large as ⅛ inch occur in cutting large mats. Most mat cutters available on the market provide means for adjusting the alignment of the guide rail and perpendicular arms. However, ad hoc adjustment of these components using a square or ruler is less than satisfactory because only individual pairs of the components of the mat cutter can be aligned at one time. Such ad hoc adjustment of separate pairs of components (i.e. the guide rail and one of the perpendicular arms, or the two perpendicular arms) with respect to each other using a ruler or square will almost invariably leave the third element (i.e. the remaining perpendicular arm, or the guide rail) out of alignment to some degree. Applicant is unaware of any prior art reference that teaches or suggests a means of simultaneously squaring both perpendicular arms and properly aligning the guide rail with respect to the perpendicular arms.

SUMMARY OF THE INVENTION

The present invention is a tool simultaneously square and align a conventional mat cutter using an elongated member (such as a rectangular block) having a bottom surface and a pair of lateral edges extending perpendicularly with respect to one another. A channel extends horizontally across the bottom surface parallel to one of these lateral edges. The vertical cross section of this channel is contoured to seat securely over the guide rail assembly to provide a fixed point of reference to alignment of the perpendicular arms of the mat cutter against the lateral edges of the tool.

A primary object of this invention is to provide a quick, simple, and accurate means of aligning and squaring a mat cutter. Another object of this invention is to provide a durable, relatively inexpensive, one-piece tool for this purpose.

DETAILED DESCRIPTION OF THE INVENTION

Figure 5:
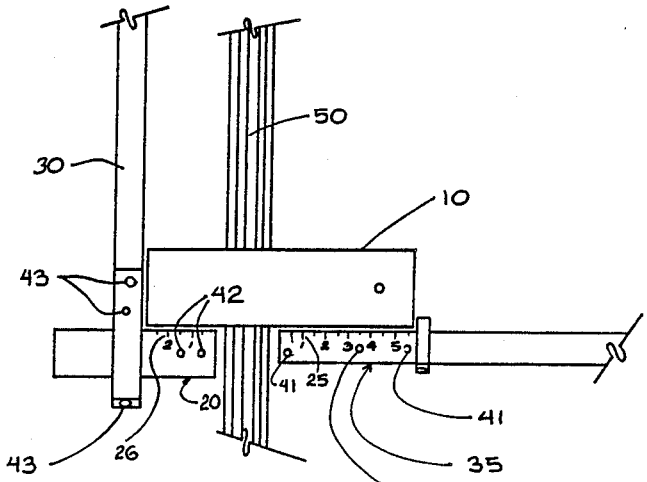
FIG. 5 is a simplified top plan view of a portion of a mat cutter showing the position of the tool during the first steps of the alignment and squaring procedure.
Figure 6:
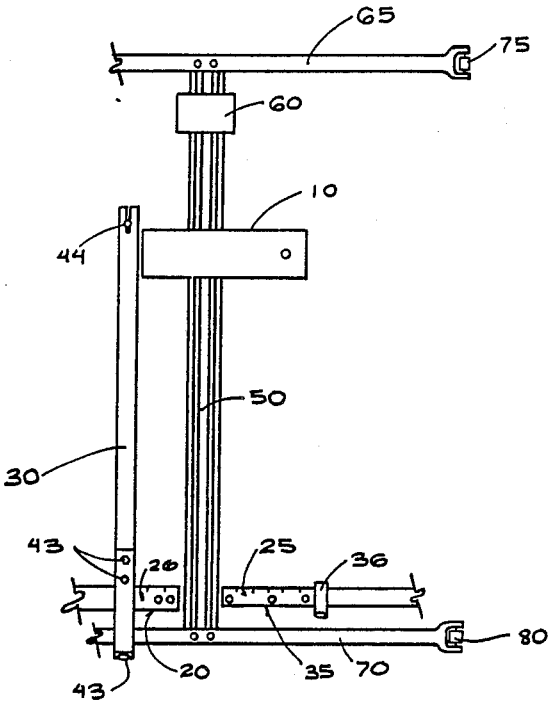
FIG. 6 is simplified top plan view of the entire mat cutter showing the position of the tool during the final step of the alignment and squaring procedure.

Turning to FIG. 6, a simplified top view is shown of one type of mat cutter presently in widespread commercial use. The cutter assembly 60 holds a sharp blade, such as a single-edged razor blade, at a desired angle to cut the mat as the cutter assembly slides along guide rail assembly 50. The guide rail assembly generally has at least one rod, rail, or track extending the length thereof to minimize lateral movement of the cutter assembly as it slides along the guide rail assembly to maintain a straight and accurate cut. The entire guide rail assembly, including the cutter assembly, is attached at either end to pivot arms 65 and 70 connected respectively to hinges 75 and 80. By this means, the guide rail assembly can be raised so that the mat can be placed under, and removed from beneath the guide rail and cutter assemblies. The mat is also held in proper position against either or both of the perpendicular arms 30 and 35. These arms are also commonly known as the mat guide 30 and the squaring arm 35, respectively. As shown in FIGS. 5 and 6, a number of adjustment screws 41 through 44 are provided to allow for adjustments in the horizontal and vertical positions of the mat guide 30 and squaring arm 35. Measuring rulers can be affixed to either or both of these arms. Most commonly, a ruler 25 is affixed to the squaring arm immediately to the right of the guide rail assembly, and another ruler 26 is affixed to the mat guide top plate 20 extending horizontally to the left of the guide rail assembly. These rulers provide a convenient means of measuring a desired offset on the mat with respect to the cutter assembly blade.

The present invention provides a simple tool to ensure that: (1) the edges of the squaring arm 35 and the mat guide top plate 20 are collinear; (2) the mat guide and squaring arms are perpendicular; and (2) the guide rail assembly is parallel to the mat guide and perpendicular to the squaring arm; and (4) the rulers affixed to the squaring arm and mat guide top plate are properly calibrated with respect to the cutting assembly blade.

The tool can be fabricated from any material having acceptable dimensional stability. Aluminum can be easily milled or molded to form the tool, and offers the advantages of being inexpensive, durable, and light weight.

Figure 1:
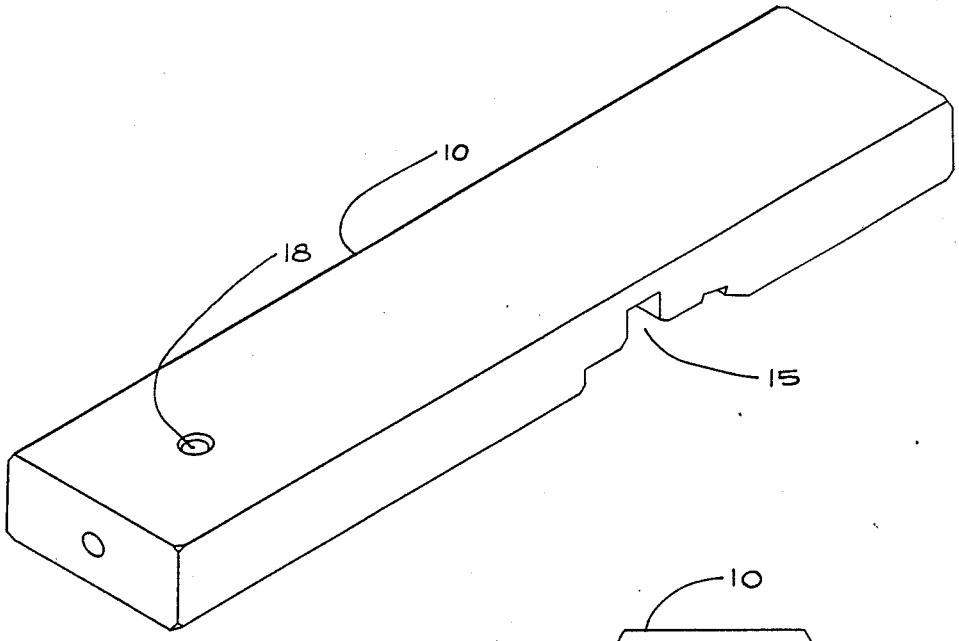
FIG. 1 is a perspective view of the alignment and squaring tool embodying the present invention.
Figure 2:
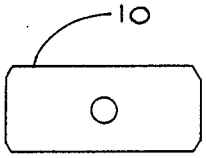
FIG. 2 is an end view of this tool.
Figure 3:
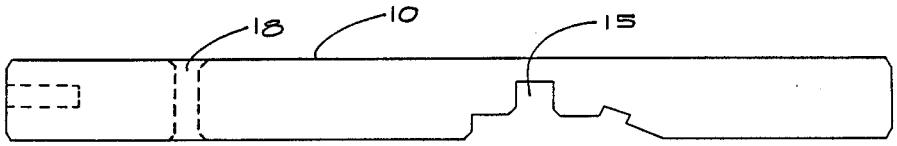
FIG. 3 is a side view of this tool.
Figure 4:
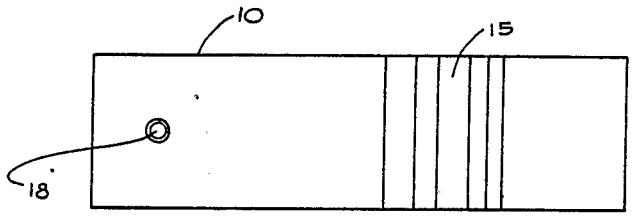
FIG. 4 is a bottom view of this tool.

FIGS. 1 through 4 show four views of the alignment tool. In the preferred embodiment, the tool, is simply a rectangular block 10 with a channel 15 cut across its bottom surface at a predetermined distance parallel to one of the lateral faces of the tool. Alternatively, the tool could have any number of horizontal contours, provided the tool has at least two perpendicular lateral edges. The channel has a vertical cross section, contoured to easily fit over, and sear firmly against the guide rail assembly 50 so as to prevent lateral movement of the tool with respect to the guide rail assembly after the tool is in place. By this means, the tool makes use of the guide rail assembly as a fixed pint of reference for alignment of the remaining components of the mat cutter. The channel shown in FIGS. 1, 2, and 4 is intended for use with a "C & H" mat cutter commonly used in the industry. Other types of mat cutters will require tools having a channel with a different cross-section, depending on the type and dimensions of the guide rail assembly involved. It should also be noted that cutting apparatuses for glass or cardboard often have designs very similar to mat cutters. The present invention could be easily adapted for use with such glass and cardboard cutter.

FIGS. 5 and 6 show the manner in which the tool is placed to align and square the mat cutter. The initial position of the tool is shown in FIG. 5. The tool 10 is placed over the lower end of the guide rail assembly 50, with the guide rail assembly passing though the channel on the bottom surface of the tool. In this position the bottom edge of the tool should rest perfectly flat against both the squaring arm 30 and the mat guide top plate 20. If this is not the case, the appropriate adjustment screws 41 and 42 on the squaring arm and/or the mat guide top plate are loosened, and the appropriate adjustments are made to these components to bring them into alignment against the tool. The adjustment screws are then tightened.

The next step is to verify that the mat guide 30 is in proper alignment. The end of the mat guide 30 adjacent to the mat guide top plate 20 should rest perfectly flat against the left end of the tool. If this is not the case, the adjustment screws 43 on the mat guide should be loosened and appropriate adjustments made to the location of the mat guide. In addition, the mat guide should intersect the ruler affixed to the mat guide top plate at the 3-inch mark. If not, appropriate adjustment is made to move the mat guide top plate 20 to the left or right as needed, by means of adjustment screws 42.

The tool is then moved to a position near the other end of the mat guide, as shown in FIG. 6. Once again, the mat guide should rest flat against the left end of the tool. If not, the adjustment screw 44 located at the end of the mat guide is loosened so that the mat guide can be moved into proper position.

In addition to the alignment procedure outlined above, the tool can also be used to calibrate the rulers attached to the mat guide top plate and the squaring arm. The dimensions of the lateral edges and location of the channel are fixed so that the tool provides convenient reference lengths for calibration of these rulers. For example, the ruler attached to the squaring arm can be replaced and calibrated using the following procedure. First, remove the old ruler from the top surface of the squaring arm. Second, place the tool in position against the squaring arm and mat guide top plate, as shown in FIG. 5. Next, a small piece of masking tape is placed on top of the squaring arm approximately one inch on either side of the right end of the tool, but not covering the area where the ruler will be place. The squaring arm stop 36 is moved against the right end of the tool. A pencil is then used to mark a line on the masking tape at the inside edge of the squaring arm stop, in line with the right end of the tool. The protective paper backing is then peeled and a new ruler is carefully applied to the top of the squaring arm so that the 6-inch marking on the ruler lines up with the pencil mark on the masking tape. This same general procedure can be used to calibrate the 3-inch ruler attached to the mat guide top plate with respect to the left end of the tool.

FIGS. 1 and 3 show a hole 18 extending vertically through the tool. This hole is used for hanging the tool on a nail or hook for storage when the tool is not in use.

I claim:

1. An alignment tool for a mat cutter having a first arm, a second arm perpendicular to said first arm, a guide rail assembly extending parallel to said first arm and a cutting assembly movable along said guide rail assembly; said alignment tool comprising an elongated member having a bottom surface; means to align said first arm relative to said guide assembly having a first lateral edge on said member and a channel extending horizontally across said bottom surface parallel to said first lateral edge, said channel comprising a vertical cross-section contoured to seat securely over said guide rail assembly, whereby said first lateral edge provides a reference for alignment of said first arm when said channel is seated on said guide rail assembly; and means to align said second arm relative to said guide assembly and said first arm.

2. The alignment tool of claim 1, wherein said means to align said second arm comprises a second lateral edge on said member perpendicular to said first lateral edge and perpendicular to said channel, whereby said second lateral edge provides a reference for alignment of said second arm when said channel is seated on said guide rail assembly.

3. An alignment tool for a mat cutter having two perpendicular arms, a guide rail assembly extending parallel to one of said perpendicular arms and perpendicular to the other of said perpendicular arms, optional measurement rulers attached to the other of said pependicular arms and a cutting assembly that can be moved along said guide rail assembly; said alignment tool comprising:

(a) an elongated member having a bottom surface, and two lateral edges extending perpendicularly with respect to one another; and (b) a channel extending horizontally across the bottom surface of said elongated member parallel to one of the lateral edges of said elongated member, said channel having a vertical cross-section contoured to seat securely over the guide rail assembly of the mat cutter, such that when said channel is seated over said guide rail assembly, the lateral edge of said elongated member parallel to said channel provides a reference for alignment of the perpendicular arm of the mat cutter parallel to said guide rail assembly, and the other lateral edge of said elongated member provides a reference for alignment of the other perpendicular arm perpendicular to said guide rail assembly.

4. The alignment tool of claim 3 wherein the dimensions of the lateral edges and the location of the channel are fixed to provide convenient reference and lengths for calibration of measurements rulers attached to the perpendicular arms of the mat cutter.

5. The alignment tool of claim 3, wherein the elongated member has a bottom surface, and a rectangular horizontal cross-section.

6. An alignment tool for a mat cutter having two perpendicular arms, optional measurement rulers attached to said perpendicular arms, a guide rail assembly extending parallel to one of said perpendicular arms and perpendicular to the other of said perpendicular arms, and a cutting assembly that can be moved along said guide rail assembly; said alignment tool comprising:

(a) a block having a rectangular horizontal cross-section, with a bottom surface and four lateral edges; and (b) a channel extending horizontally across said bottom surface parallel to two of said lateral edges, said channel having a vertical cross-section contoured to seat securely over the guide rail assembly of the mat cutter, such that when said channel is seated over said guide rail assembly, one of the lateral edges of said block parallel to said channel provides a reference for alignment of the perpendicular arm of the mat cutter parallel to said guide rail assembly, and a second of said lateral edges provides a reference for alignment of the other perpendicular arm perpendicular to said guide rail assembly.

* * * * *